US005697612A

United States Patent [19]

Piotrowski et al.

[11] Patent Number: 5,697,612

[45] Date of Patent: Dec. 16, 1997

[54] JET BUMPER FOR A PINBALL GAME

[75] Inventors: Peter J. Piotrowski; Walter D. Roeder, both of Chicago, Ill.

[73] Assignee: Williams Electronics Games, Inc.

[21] Appl. No.: 489,821

[22] Filed: Jun. 13, 1995

Related U.S. Application Data

[63] Continuation of Ser. No. 200,207, Feb. 23, 1994, abandoned.

[51] Int. Cl.[6] ..... A63F 7/30

[52] U.S. Cl. ..... 273/127 R; 273/118.4; 273/121.7; 273/129 S

[58] Field of Search ..... 273/118–121, 127 R, 273/127 B, 127 C, 129 R, 129 S

[56] References Cited

U.S. PATENT DOCUMENTS

| | | | |
|---|---|---|---|
| 3,826,883 | 7/1974 | Foster et al. | 273/127 R X |
| 3,877,701 | 4/1975 | Foster et al. | 273/119 A |
| 5,044,635 | 9/1991 | Oermann | 273/127 R |
| 5,158,291 | 10/1992 | Biagi et al. | 273/119 A X |
| 5,415,403 | 5/1995 | Ritchie et al. | 273/127 R X |
| 5,417,423 | 5/1995 | Oursler et al. | 273/127 R |

*Primary Examiner*—Raleigh W. Chiu

*Attorney, Agent, or Firm*—Rudnick & Wolfe

[57] ABSTRACT

The jet bumper of the invention consists of a body mounted to the playfield. A solenoid actuator and rebound ring are mounted on the body. An eddy current sensor is disposed about the body to detect the approach of a ball. Upon detection of the ball, the eddy current sensor energizes the solenoid actuator to retract the rebound ring and propel the ball.

13 Claims, 3 Drawing Sheets

JET BUMPER FOR A PINBALL GAME

This is a continuation of application Ser. No. 08/200,207 filed on Feb. 23, 1994, now abandoned.

BACKGROUND OF THE INVENTION

The invention relates, generally, to pinball games and, more particularly, to an improved jet bumper for such games.

The typical pinball game includes an inclined playfield supporting a plurality of play features such as targets, ramps, bumpers, skill shots and the like, a rolling ball and player operated flippers. The player operates the flippers to propel the ball at selected play features thereby to score points and control play of the game.

One such play feature commonly found on pinball games is a ball actuated jet bumper. A typical jet bumper is shown in FIG. 1 and is of a construction that has been commonly used in the industry for many years. Specifically, the jet bumper consists of a body 1 connected to a support piece 3 with electro-mechanical ball sensor 5 trapped therebetween. Ball sensor 5 consists of a ring 7 that extends around body 1 and has a pin 9 formed integrally therewith. Specifically, pin 9 extends from ring 7 to a position below playfield 11. The ring 7 moves relative to body 1 when contacted by a ball B and is held centered relative thereto by spring 13.

Fitted over body 1 and located near the top thereof is a rebound ring 15. Rebound ring 15 is supported on a pair of posts 17 that are in turn fixed to the plunger 19 of solenoid 21 by bracket 23. A bracket 31 is connected to playfield 11 to support solenoid 21. When solenoid 21 is activated, plunger 19 will retract thereby retracting posts 17 to move ring 15 sharply downward, as indicated by arrow A in FIG. 1, to contact ball B and propel it over the playfield 11.

A light bulb 35 is mounted inside of body 1 and the body is enclosed by cover 37. Cover 37 is releasably secured to body 1 by screws (not shown) to allow access to bulb 35. Because the electro-mechanical ball sensor 5 is centrally located in body 1, the light bulb 35 can only be accessed from the top of the playfield by removing the cover 37.

Mounted to the underside of playfield 11 is switch 25. Switch 25 consists of a first electrical contact 27 and a second electrical contact 29. When the contacts touch, a signal is generated that energizes solenoid 21 to cause the bumper to operate as described above. An actuator arm 33 including cup 35 at the distal end thereof is mounted above contact 27. Cup 35 receives pin 9 such that when the pin is moved by contact of a ball with ring 7, the pin will push against cup 35 to depress actuator arm 33 and thereby close contacts 27 and 29.

As will be apparent from the foregoing description, the existing jet bumper has numerous moving parts which increase the cost of production. Moreover, all of the moving parts must be assembled on the playfield in precise relative location to allow the bumper to operate properly. Over time these components can become worn or misaligned requiring replacement or adjustment.

Thus, an improved jet bumper for a pinball game is desired.

SUMMARY OF THE INVENTION

The jet bumper of the invention consists of a body mounted to the playfield. The solenoid actuator and rebound ring are mounted on the body in a manner similar to the prior art jet bumper; however, the electro-mechanical ball sensor of the prior art jet bumper has been replaced by an eddy current sensor. The eddy current sensor is preferably disposed surrounding the body to detect the approach of a ball to the bumper. Upon detection of the ball, the eddy current sensor energizes the solenoid actuator to retract the rebound ring and propel the ball. Thus, the complicated electro-mechanical ball sensor of the prior art is replaced by an eddy current sensor having no moving parts. The manufacturing cost, assembly time, physical wear and the alignment and adjustment problems of the prior art are eliminated.

DETAILED DESCRIPTION OF THE INVENTION

Figure 2:
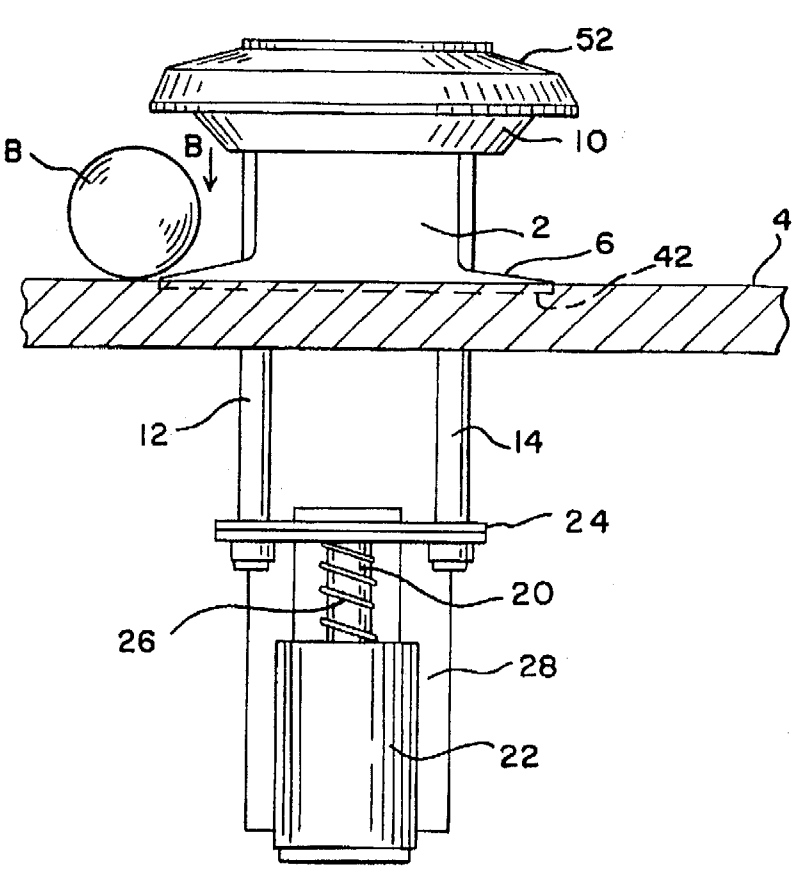
FIG. 2 is a front view of the jet bumper of the invention.
Figure 1:
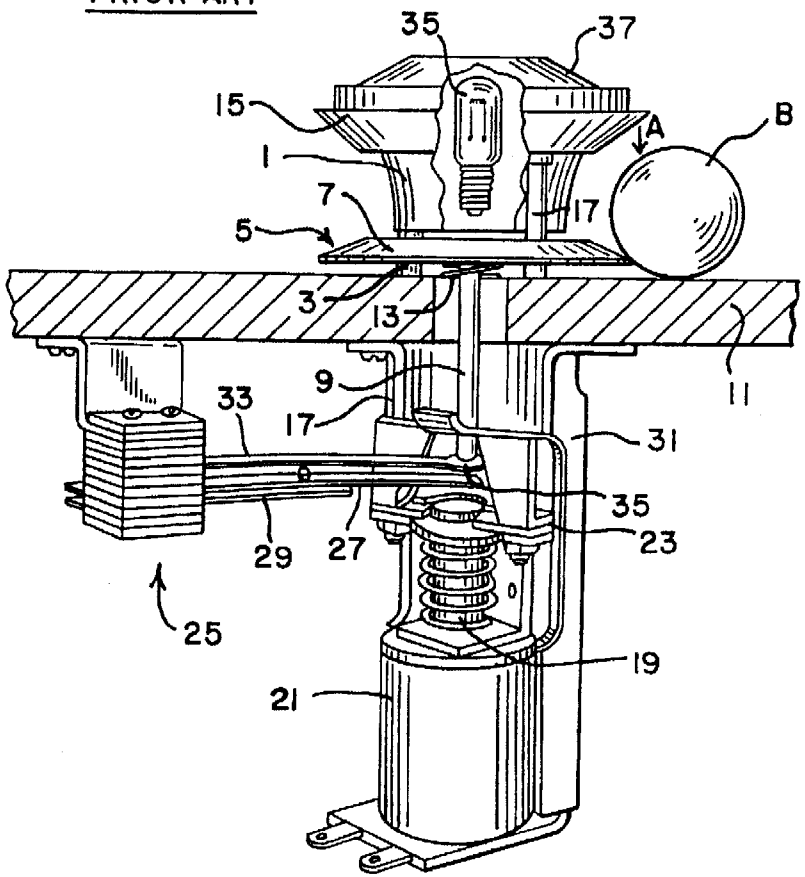
FIG. 1 PRIOR ART
FIG. 1 is a perspective view of the prior art jet bumper.
Figure 4:
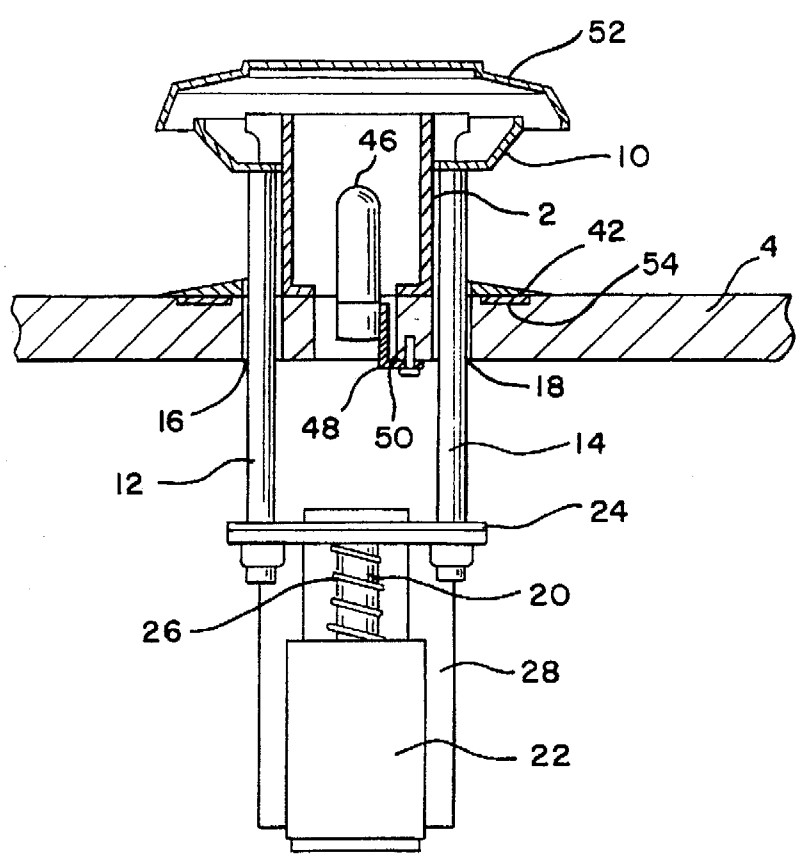
FIG. 4 is a section view taken along line 4—4 of FIG. 3.
Figure 3:
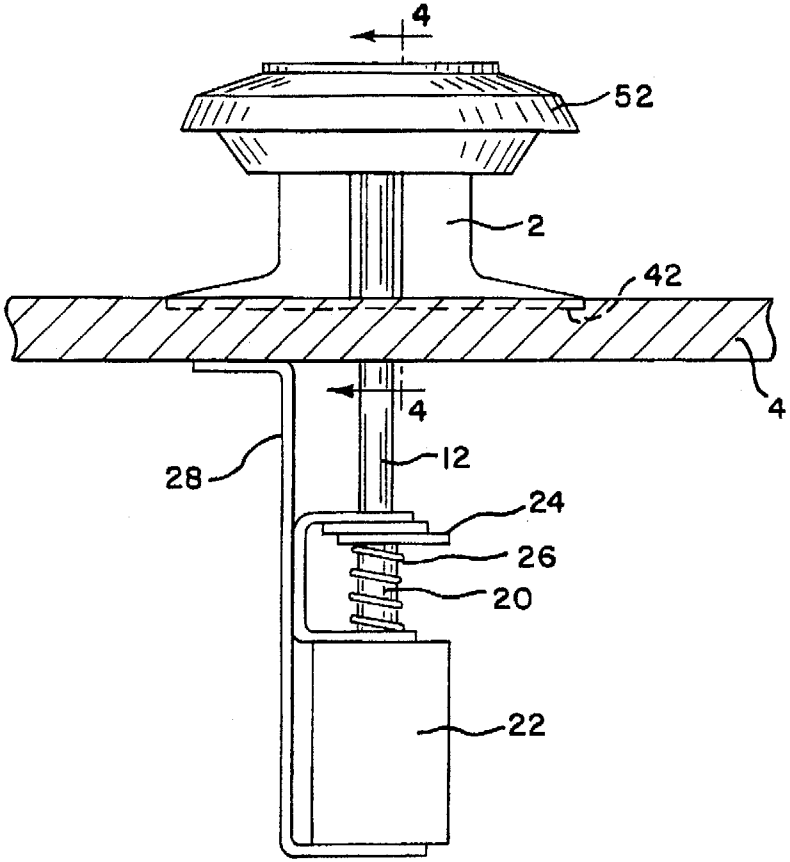
FIG. 3 is a side view of the bumper of the invention.

Referring more particularly to FIGS. 2–4, the bumper of the invention consists of a body 2 fixed to the surface of playfield 4. Body 2 is a hollow cup having an annular flange 6 extending from the bottom thereof. Flange 6 is tapered to terminate flush with playfield 4 such that a ball B can roll onto it.

A rebound ring 10 is fitted over body 2 and is dimensioned so as to be slidably movable relative to body 2 in the vertical direction. Rebound ring 10 is supported in a manner similar to that of the prior art bumper. Specifically, posts 12 and 14 are fixed to rebound ring 10 on opposite sides thereof. Posts 12 and 14 extend through apertures 16 and 18 in the playfield (FIG. 4) and are fixed to plunger 20 of solenoid actuator 22 via yoke 24. A compression spring 26 is trapped between solenoid actuator 22 and yoke 24 to maintain rebound ring 10 in the illustrated position when solenoid actuator is not energized. A mounting bracket 28 is fixed to the underside of playfield 4 and supports solenoid actuator 22.

When a ball is detected (as will hereinafter be described), solenoid actuator 22 is energized to retract plunger 20 thereby sharply to pull down rebound ring 10 in the direction of arrow B of FIG. 2. This causes the ring to strike ball B and propel it over the playfield.

Figure 5:
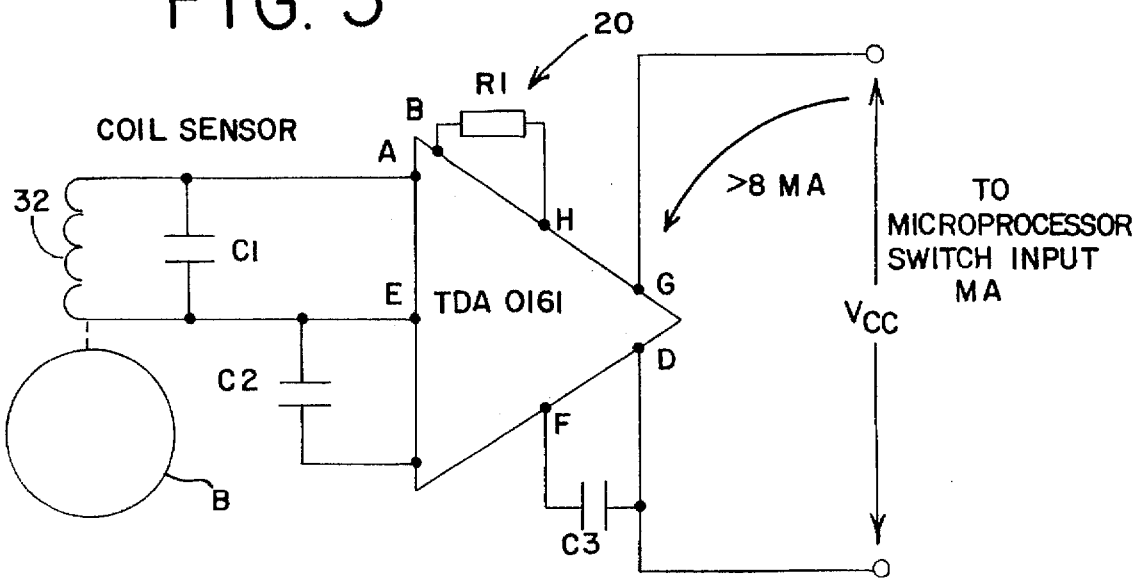
FIG. 5 is a circuit diagram for an eddy current sensor.

To detect the presence of ball B in the jet bumper of the invention, the complicated electro-mechanical ball sensor of the prior art is replaced by an eddy current sensor. Referring to FIG. 5, there is illustrated a simplified circuit diagram for an eddy current sensor. The circuit employs a proximity detector integrated circuit 30 which operates by detecting the variation in high frequency eddy current losses. Using an external tuned circuit as its input, it acts as an oscillator. The output signal level is altered by an approaching ferromagnetic object, such as pinball B. The proximity detector circuit 30 may be of a commercially available type, such as part number TDA0161 manufactured by SGS-Thomson Microelectronics.

As shown in FIG. 5, an inductor 32 constitutes the sensor which is provided to inputs A and E of the proximity detector 30. When the effective AC parallel resistance falls below the value of $R_1$, the proximity detector 30 registers detection of the metallic object. The resistance is affected by the eddy currents induced in coil 32 as a function of the distance of ball B to the coil.

In a preferred embodiment, the circuit components have the following values:

$R_1$=0 to 5 kilo-c $C_1$=0.001 μf $C_2$=0.001 μf

The output from the detector circuit is provided to a transistor coupling circuit or any similar device, known in this art, which in turn connects to switch matrix for the microprocessor for the pinball game.

Figure 6:
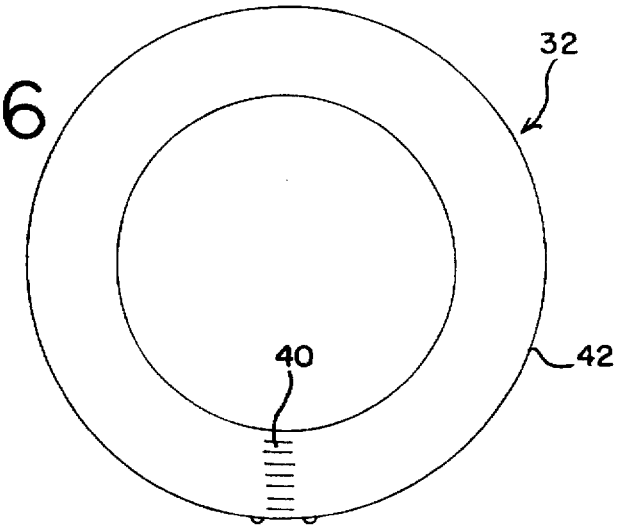
FIG. 6 is a detailed view of one embodiment of the sensor coil of FIG. 5.
Figure 7:
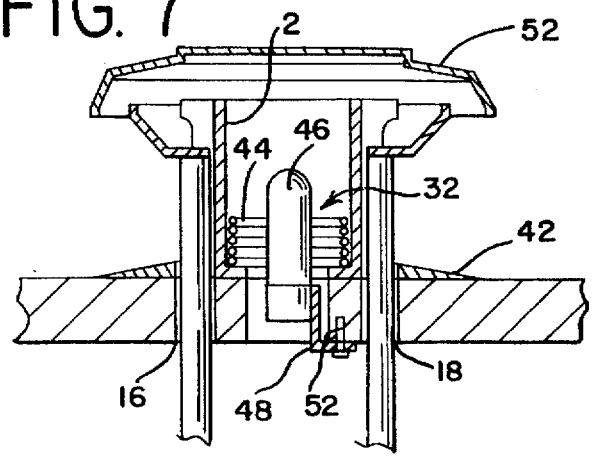
FIG. 7 is a detailed view of an alternate arrangement for the sensor coil.

In a preferred embodiment, the resistive coil 32, described with reference to FIG. 6, consists of a wire winding 40 bonded to a circuit board 42. As shown in FIGS. 2 and 4, the circuit board is preferably located below flange 6 in cut-out 54 in playfield 8 or can be bonded directly to flange 6. Alternatively, the resistive coil 32 could consist of a wire winding 44 located inside of body 2 as shown in FIG. 7. The resistive coil could also consist of a film such as a polyester film of the type sold under the trademark Mylar having silver ink "wiring" printed on the film where the film is arranged in a ring surrounding the bumper. Such resistive film is commonly used in light dimmer switches. It is to be understood that the resistive coil 33 can have any construction that will have detectable eddy currents induced therein by the ferromagnetic ball.

Body 2 is covered by a transparent or translucent cap 52 and a light source such as light bulb 46 is located inside of body 2 to illuminate the bumper. Specifically, light bulb 46 is mounted on an L-bracket 48 and L-bracket 48 is releasably secured to playfield 8 by screws 50 as best shown in FIG. 4. Because the electro-mechanical ball sensor of the prior art has been eliminated, the central portion of body 2 is unobstructed and the light source 46 can be quickly and easily accessed from the bottom of the playfield by removing screws 50. This feature offers a distinct advantage over the prior art design where the cap had to be removed to access the light source because the electro-mechanical ball sensor was located in and below the body. The advantage of the present design can be better appreciated when it is realized that the majority of the electronics and mechanics for a pinball game are located below the playfield such that the playfield is pivoted to a substantially vertical position for maintenance and repair. Thus, unlike the bumper of the prior art, the jet bumper of the invention can be entirely maintained from below the playfield.

In operation, the jet bumper of the invention normally is in the illustrated position of FIG. 2. The eddy current sensor and rebound ring are arranged such that a ball can approach the bumper from any direction. Upon the approach of the pinball to the jet bumper, eddy currents will be induced in coil 32. As a result of these eddy currents, a signal will be generated indicative of the presence of the ball. This signal is preferably delivered to the switch matrix of the game microprocessor and the microprocessor activates solenoid 22 in response thereto. The actuation of solenoid 22 retracts plunger 20 and posts 12 and 14 thereby moving rebound ring 10 downward as illustrated by Arrow B in FIG. 2. As rebound ring 10 moves downward, it strikes ball B to propel it over the playfield.

As will be appreciated from the foregoing description, the jet bumper of the invention has a greatly simplified design over that of the prior art bumper. The jet bumper has fewer moving parts and is, therefore, simpler and more economical to manufacture, install and maintain and should have a longer useful lifetime than the prior art bumper.

While the invention has been described in some detail with respect to the drawings, it will be appreciated that numerous changes in the details and construction of the invention can be made without departing from the spirit and scope of the invention as set forth in the appended claims.

What is claimed is:

1. An improved jet bumper for propelling a ferromagnetic ball over the inclined playfield of a pinball game, comprising:

(a) a housing having a bottom portion to be mounted flush with the playfield, said housing having a centrally disposed, unobstructed portion;

(b) means, mounted to said housing within said centrally disposed portion, for illuminating the bumper, said illuminating means being quickly and easily accessible from the bottom of the said playfield for service;

(c) a rebound ring fitted over said housing for movement relative thereto;

(d) means for detecting the approach of a ball prior to its contact with said housing; and (e) means, responsive to said detecting means, for moving said rebound ring to contact the ball thereby to propel it over the playfield away from said jet bumper.

2. The jet bumper of claim 1 wherein said detecting means comprises an eddy current sensor for generating a signal when a ball is detected approaching said housing.

3. The jet bumper of claim 1 wherein said moving means includes a solenoid.

4. In combination with a pinball game having an inclined playfield for supporting a ferromagnetic ball, a jet bumper comprising:

a) a bumper body;

b) a surface, movable with respect to the bumper body, for propelling the ball away from the bumper body;

c) an eddy current sensor for detecting the presence of the ball when the ball is proximate the bumper body and for generating a signal in response thereto; and d) means for moving the movable surface in response to the signal from the eddy current sensor, wherein the sensor comprises a film which surrounds the bumper body.

5. In combination with a pinball game having an inclined playfield for supporting a ferromagnetic ball, a jet bumper comprising:

a) bumper body;

b) a surface movable with respect to the bumper body, for propelling the ball away from the bumper body;

c) an eddy current sensor for detecting the presence of the ball when the ball is proximate the bumper body and for generating a signal in response thereto; and d) means for moving the movable surface in response to the signal from the eddy current sensor, wherein the jet bumper further comprises a tapered flange that is fixed with respect to the bumper body.

6. The pinball game of claim 5, wherein the sensor is disposed within the tapered flange.

7. The pinball game of claim 5, wherein the sensor is embedded in the playfield.

8. In combination with a pinball game having an inclined playfield for supporting a ferromagnetic ball, a jet bumper comprising:

a) a bumper body;

b) a surface, movable with respect to the bumper body, for propelling the ball away from the bumper body;

c) an eddy current sensor for detecting the presence of the ball when the ball is proximate the bumper body and for generating a signal in response thereto; and d) means for moving the movable surface in response to the signal from the eddy current sensor, wherein the sensor comprises a wire coil located inside the bumper body.

9. In combination with a pinball game having an inclined playfield for supporting a ferromagnetic ball, a jet bumper comprising:

a) a cylindrical bumper body fixed with respect to the playfield for housing a light bulb therein;

b) a rebound ring mounted concentrically with the bumper body and movable with respect thereto for propelling the ball away from the body;

c) an eddy current sensor for detecting the presence of the ball when the ball moves proximate the body and for generating a signal in response to the ball's motion;

d) means for moving the rebound ring in response to the signal from the sensor, wherein the sensor comprises a film which surrounds the bumper body.

10. The pinball game of claim 9, wherein the sensor is embedded in the playfield.

11. In combination with a pinball game having an inclined playfield for supporting a ferromagnetic ball, a jet bumper comprising:

a) a cylindrical bumper body fixed with respect to the playfield for housing a light bulb therein;

b) a rebound ring mounted concentrically with the bumper body and movable with respect thereto for propelling the ball away from the body;

c) an eddy current sensor for detecting the presence of the ball when the ball moves proximate the body and for generating a signal in response to the ball's motion;

d) means for moving the rebound ring in response to the signal from the sensor, wherein the bumper is provided with a tapered flange that is fixed with respect to the bumper body.

12. The pinball game of claim 11, wherein the sensor is disposed within the tapered flange.

13. In combination with a pinball game having an inclined playfield for supporting a ferromagnetic ball, a jet bumper comprising:

a) a cylindrical bumper body fixed with respect to the playfield for housing a light bulb therein;

b) a rebound ring mounted concentrically with the bumper body and movable with respect thereto for propelling the ball away from the body:

c) an eddy current sensor for detecting the presence of the ball when the ball moves proximate the body and for generating a signal in response to the ball's motion;

d) means for moving the rebound ring in response to the signal from the sensor, wherein the sensor comprises a wire coil located in an interior of the bumper body.

* * * * *